US005758613A

United States Patent [19]

Edelmayer et al.

[11] Patent Number: 5,758,613

[45] Date of Patent: Jun. 2, 1998

[54] HYDRAULIC LASH ADJUSTER AND BIASED NORMALLY OPEN CHECK VALVE SYSTEM THEREFOR

[75] Inventors: Thomas C. Edelmayer, Battle Creek; George A. Hillebrand, Hickory Corners; Robert G. Paulson, Jr., Battle Creek, all of Mich.

[73] Assignee: Eaton Corporation, Cleveland, Ohio

[21] Appl. No.: 792,809

[22] Filed: Jan. 30, 1997

[51] Int. Cl.[6] ..... F01L 1/16; F01L 1/24

[52] U.S. Cl. ..... 123/90.35; 123/90.36; 123/90.46; 123/90.55; 74/569

[58] Field of Search ..... 123/90.33, 90.35, 123/90.36, 90.41, 90.45, 90.46, 90.48, 90.52, 90.55, 90.57; 74/569

[56] References Cited

U.S. PATENT DOCUMENTS

| | | | |
|---|---|---|---|
| 3,406,668 | 10/1968 | Donnelly et al. | 123/90.55 |
| 4,004,558 | 1/1977 | Schiebe | 123/90.35 |
| 4,054,109 | 10/1977 | Herrin et al. | 123/90.55 |
| 4,633,827 | 1/1987 | Buente | 123/90.55 |
| 4,721,076 | 1/1988 | Goppelt et al. | 123/90.57 |
| 4,788,947 | 12/1988 | Edelmayer | 123/90.55 |
| 4,807,576 | 2/1989 | Sonoda et al. | 123/90.57 |
| 5,509,385 | 4/1996 | LaVieri | 123/90.35 |
| 5,622,147 | 4/1997 | Edelmayer | 123/90.35 |
| 5,632,237 | 5/1997 | Cornell et al. | 123/90.55 |

*Primary Examiner*—Weilun Lo
*Attorney, Agent, or Firm*—L. J. Kasper

[57] ABSTRACT

A hydraulic lash adjuster of the sealed leakdown type in which the plunger assembly (15) is received within a blind bore (13) defined by a body (11). The plunger assembly (15) includes upper (17) and lower (19) plunger elements, to define a low pressure chamber (21) and a high pressure chamber (23). In one embodiment, a dynamic seal member (27) is disposed between the lower plunger element (19) and the bore (13), such that leakdown flow must go from the high pressure chamber (23), past a check ball (53), to the low pressure chamber (21). In order to achieve a more consistent operation of the lash adjuster, the check ball (53) is normally biased toward an open position (FIG. 1) by a compression spring (69), but as flow from the chamber (23) to the chamber (21) increases, the spring force is overcome, and the check ball (53) seats in the desired manner.

13 Claims, 2 Drawing Sheets

HYDRAULIC LASH ADJUSTER AND BIASED NORMALLY OPEN CHECK VALVE SYSTEM THEREFOR

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates generally to hydraulic lash adjusters, and more particularly to a hydraulic lash adjuster of the type in which a check valve provides at least some of the leakdown flow from the pressure chamber to the reservoir.

Hydraulic lash adjusters (also sometimes referred to as "lifters") for internal combustion engines have been in use for many years to eliminate clearance, or lash, between engine valve train components under varying operating conditions, in order to maintain efficiency and to reduce noise and wear in the valve train. Hydraulic lash adjusters operate on the principle of transmitting the energy of the valve actuating cam through hydraulic fluid, trapped in a pressure chamber under a plunger. During each operation of the cam, as the length of the valve actuating components vary as a result of temperature changes and wear, small quantities of hydraulic fluid are permitted to enter the pressure chamber, or escape therefrom, thus effecting an adjustment in the position of the plunger, and consequently adjusting the effective total length of the valve train.

The cam operating cycle comprises two distinct events: (1) operation on the base circle and (2) valve actuation. The base circle event is characterized by a constant radius between the cam center of rotation and the can follower, and during this event, no cam energy is transmitted. The valve actuation event is characterized by a varying radius between the cam center of rotation and the cam follower, which effectively transmits cam energy to open and close an engine valve. During the valve actuation event, a portion of the load resulting from the valve spring, the inertia of valve train components, and cylinder pressure are transmitted through the valve train and through the lash adjuster. The load increases the pressure of the hydraulic fluid within the lash adjuster pressure chamber, in proportion to the plunger area, and in typical hydraulic lash adjusters currently in commercial production, fluid escapes the pressure chamber between the plunger and the wall of the lash adjuster body. Such a device is referred to as a "conventional leakdown" lash adjuster.

As the fluid escapes, the volume or the pressure chamber is decreased and the plunger moves down, shortening the effective length of the lash adjuster. During the base circle event, the lash adjuster plunger spring moves the plunger up within the body such that no clearance or lash exists between valve actuation components. As this occurs, hydraulic fluid is drawn into the pressure chamber through the plunger check valve in response to the increasing volume of the pressure chamber as the plunger moves up. If the effective length of the valve train shortens during the valve actuation cycle, positive lash is created and the lash adjuster extends, moving the plunger to a higher position at the end of the cycle than at the beginning. Conversely, if the effective length of the valve train increases during the valve actuation cycle, negative lash is created and the lash adjuster contracts, moving the plunger to a lower position at the end of the cycle than at the beginning. The latter condition typically occurs when valve train components lengthen in response to increasing temperature.

As noted previously, commercial lash adjusters of the conventional leakdown; type have controlled the escape of fluid from the high pressure chamber (or "leakdown") solely by the fit of the plunger within the body, thus necessitating close clearances therebetween, and selective fitting of the plunger to the body. In an effort to overcome the expense of such selective fitting of the plunger within the body, as well as other associated disadvantages of the prior art, the assignee of the present invention has developed a lash adjuster in which the leakdown flow is past the plunger check valve. This improved lash adjuster is illustrated and described in co-pending application U.S. Ser. No. 613,273, filed Mar. 8, 1996, in the name of Thomas C. Edelmayer for a "HYDRAULIC LASH ADJUSTER", assigned to the assignee of the present invention and incorporated herein by reference.

Lash adjusters of the type disclosed in the above-identified co-pending application are referred to as having "sealed leakdown" systems. In connection with the development of the sealed leakdown type lash adjusters, it has been determined that it is necessary to assemble such lash adjusters into the engine without fluid (i.e., assemble the lash adjuster "dry"), and after the engine begins to run, oil is pumped into the lash adjuster in a manner well known to those skilled in the art. If such lash adjusters were already filled with hydraulic fluid, prior to assembly into the engine, the assembly process would be nearly impossible. In a sealed leakdown lash adjuster, the check valve constitutes the only fluid passage between the high pressure chamber and the reservoir so that a compressive load imposed on the plunger results in fluid being displaced through the check valve. During the assembly process, at normal assembly speeds, the hydrodynamic forces generated by the flow of fluid through the check valve are sufficient to close the check valve before the lash adjuster is shortened enough to permit assembly.

It has become conventional for the check valve to comprise a ball, and for the check valve seat to comprise a straight tapered cone surface. During testing of the assembled lash adjuster, there is periodically one in which the valve leaks, typically because of surface imperfections of the valve seat. In such cases, it is common practice to hone the valve seat in order to remove such imperfections, and this would typically be achieved by means of a tapered, conical honing wheel. As will be apparent to those skilled in the art, unless the taper on the honing wheel is nearly a perfect match for the taper of the seat, the honing, process may result in a substantial amount of material being removed before the cause of the leak is corrected, thus making the seat repair process time consuming and expensive, sometimes to the point of being economically worthwhile.

BRIEF SUMMARY OF THE INVENTION

Accordingly, it is an object of the present invention to provide an improved hydraulic lash adjuster of the sealed leakdown type which makes it feasible to fill the lash adjuster with hydraulic fluid prior to assembly into the engine.

It is another object of the present invention to provide an improved hydraulic lash adjuster which is operable to reduce cycle-to-cycle variations in valve timing events.

It is a further object of the present invention to provide an improved hydraulic lash adjuster in which the check valve seat configuration is such that, whenever necessary, the seat may be repaired quickly and economically.

The above and other objects of the invention are accomplished by the provision of a hydraulic lash adjuster for an internal combustion engine, the lash adjuster comprising a body defining a blind first bore formed therein. A plunger assembly is slidingly received within the blind first bore, and a pressure chamber is defined by the blind first bore and the plunger assembly. A fluid chamber is disposed within the plunger assembly, and a supply of hydraulic fluid is within the fluid chamber. The plunger assembly defines a valve opening providing fluid communication between the pressure chamber and the fluid chamber, and a check valve member is operatively associated with the valve opening for opening or closing the valve opening in response to a relative decrease or a relative increase, respectively in the pressure chamber. The biasing means normally urges the plunger assembly outward of the blind first bore.

The improved hydraulic lash adjuster is characterized by means operable to bias the check valve member toward an open position in opposition to the force of fluid flowing from the pressure chamber past the check valve member and through the valve opening to the fluid chamber. The lash adjuster is further characterized by means operable to limit the movement of the check valve member toward the open position, away from the valve opening.

DETAILED DESCRIPTION OF THE PREFERRED EMBODIMENT

Figure 1:
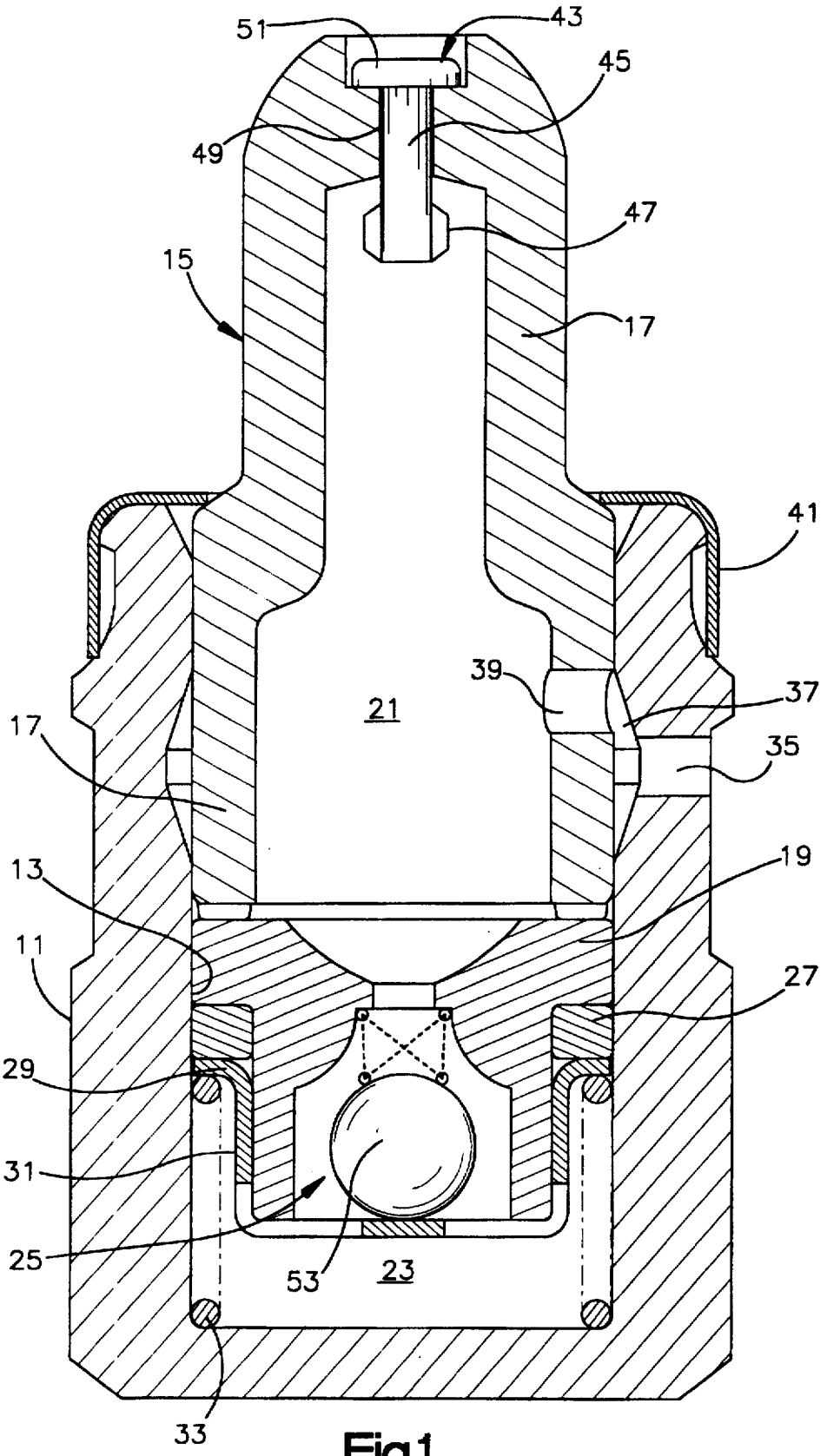
FIG. 1 is an axial cross-section of a lash adjuster made in accordance with the present invention, and with the plunger check valve in the fully open position.

Referring now to the drawings, which are not intended to limit the invention, FIG. 1 illustrates a hydraulic lash adjuster made in accordance with the teachings of the present invention.

The lash adjuster of the present invention comprises a body 11 defining a blind bore 13. A plunger assembly, generally designated 15 is slidably disposed within the blind bore 13, and includes an upper plunger element 17, and a lower plunger element 19. The plunger elements 17 and 19 cooperate to define a low pressure chamber 21 (also referred to hereinafter as a "reservoir"). The blind bore 13 and the plunger assembly 15 cooperate to define a high pressure chamber 23 (also referred to hereinafter as the "pressure chamber"). A check valve assembly, generally designated 25, is operable to permit fluid communication between the reservoir 21 and the pressure chamber 23.

Disposed between the lower plunger element 19 and the bore 13 is a dynamic seal member 27, against which is seated a flange 29 extending radially outwardly from a generally cup-shaped retainer 31. Although the subject embodiment is of the sealed reservoir type, it should be understood that the present invention can also be used advantageously in conventional leakdown type lash adjusters. Preferably, there is an interference fit between the retainer 31 and the reduced diameter portion of the lower plunger element 19. The plunger assembly 15 and the retainer 31 are maintained in the position shown by means of a plunger spring 33.

In the subject embodiment, hydraulic fluid is supplied to the low pressure chamber 21 through a port 35 which opens into the bore 13, and intersects a collector groove 37. The groove 37 also intersects a port 39 defined by the upper plunger element 17, and opening into the low pressure chamber 21. A cap member 41 retains the plunger assembly in a manner well known to those skilled in the art. Metered hydraulic fluid is supplied to the engine rocker arm (not shown) by means of a valve assembly, generally designated 43, which allows a limited flow of fluid outward from the plunger assembly 15, but which also acts as a check valve to prevent the inflow of air in the event of a low pressure or negative pressure condition within the chamber 21. The valve assembly 43, the details of which form no part of the present invention, is illustrated herein as including a pin 45 having outwardly extending portions 47 which can be compressed to snap the pin 45 into place through a port 49 formed in the end of the upper plunger element 17. Preferably, a head 51 is formed on the upper end of the pin 45, and is operable to seat against an adjacent surface and serve as the check valve.

Although the embodiment illustrated in FIG. 1 is a preferred embodiment, it will be understood by those skilled in the art that various other means, such as a gravity flow or a self-contained supply, can be provided to supply fluid to the low pressure chamber or reservoir 21, and that hydraulic fluid can be provided to the rocker arm by various other means, all within the scope of the present invention.

Figure 2:
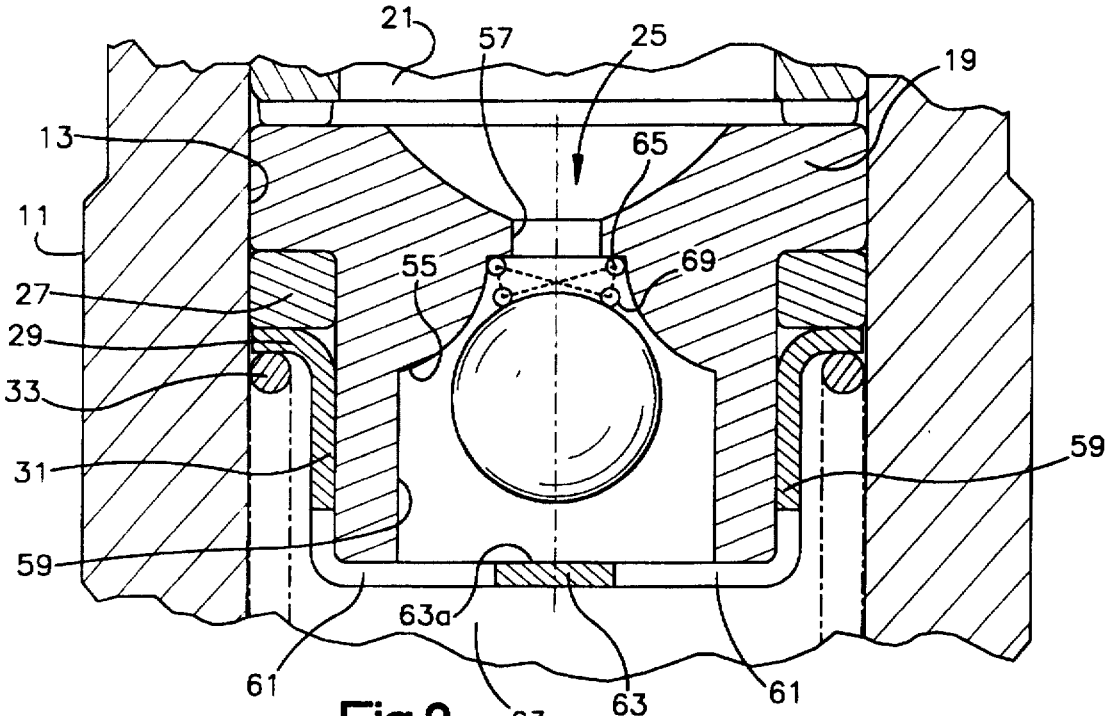
FIG. 2 is an enlarged, fragmentary, axial cross-section, similar to FIG. 1, illustrating the plunger check valve in its closed position.

Referring now to FIG. 2, in conjunction with FIG. 1, the check valve assembly 25 comprises a check ball 53 which is operable to engage a valve seat 55 which is defined by a surface formed between a valve opening 57 and a bore 59, the bore 59 being defined by the bottom of the lower plunger element 19. In its normal function as a check valve, the check ball will be disposed away from the valve seat 55 when the plunger assembly 15 is moving upward, under the influence of the plunger spring 33, permitting hydraulic fluid to flow from the reservoir 21, through the valve opening 57 and the bore 59 into the high pressure chamber 23. In order to facilitate such flow, the retainer 31 defines a plurality of cut out areas 61, but preferably, the retainer 31 should include a solid, central portion 63, including an upper surface **63*a*, to limit the movement of the check ball 53, away front the valve seat 55, to the fully open position illustrated in FIG. 1**.

The lower plunger element 19 defines a spring seat 65, disposed at the upper end of the valve seat 55, the spring seat preferably being concentric with the valve opening 57. Disposed against the spring seat 65 is a helical compression spring 69, having its lower end in engagement with the check ball 53. As was mentioned in the BACKGROUND OF THE DISCLOSURE, the known sealed leakdown-type of lash adjuster is assembled "dry" into the engine, which is undesirable, because the lash adjuster does not operate properly until all of the air has been purged from both the low and high pressure chambers 21 and 23.

Therefore, in accordance with one aspect of the present invention, the spring 69 is selected, in terms of its spring rate, number of turns, etc., such that the check ball 53 is maintained at a predetermined, repeatable distance from the valve seat 55, in the absence of hydrodynamic forces acting on the check ball 53. As the plunger assembly 15 is subjected to an external force from the rocker arm, the plunger assembly 15 begins to move downwardly, thus decreasing the volume of the high pressure chamber 23, and causing leakdown flow from the high pressure chamber 23, through the bore 59, then through the orifice defined between the ball 53 and the valve seat 55. The leakdown fluid then flows through the valve opening 57 and into the reservoir 21. In accordance with one important aspect of the invention, the spring 69 results in a known, predictable leakdown orifice between the check ball 53 and the valve seat 55, thus providing more consistent leakdown flow and lash adjuster operation.

With further downward movement of the plunger assembly 15, the pressure in the high pressure chamber 23 continues to increase and fluid flows past the check ball 53. The hydrodynamic drag force generated by the fluid flowing past the check ball 53 causes the check ball to move upward in opposition to the downward biasing force of the spring 69, thus gradually reducing the leakdown flow. This drag force is proportional to the fluid velocity, the fluid viscosity, and the frontal area of the check ball. The forces acting to hold the check valve open include the inertia of the check ball, gravity acting on the check ball, and the spring load. Eventually, the cheek ball 53 reaches its closed position, in engagement with the valve seat 55, the position which it is approaching in FIG. 2. At this point in the operation of the lash adjuster, fluid communication from the high pressure chamber 23 to the reservoir 21 is effectively blocked, trapping pressurized fluid in the chamber 23, such that the lash adjuster is effectively a "solid" member.

One important benefit of the present invention is that the lash adjuster, including the check valve assembly 25, may be used in various orientations and operating angles without adversely effecting the operation thereof in terms of cycle-to-cycle variations With the prior art lash adjuster, using a "free" check ball open only as a result of its own weight, deviating from a substantially vertical orientation would result in even greater inconsistency of operation. However, the check ball 53 in the subject embodiment is effectively "forced" or biased toward the open position of FIG. 1 in such a way that there is a predictable, repeatable leakdown orifice between the check ball 53 and the valve seat 55.

Although the subject embodiment includes a helical compression spring 69 biasing the check ball 53 toward the open position of FIG. 1, those skilled in the art will understand that the invention is not so limited. Various other spring configurations could be utilized, within the scope of the invention, an example being a leaf spring, having one end thereof supported by the lower plunger element 19, and the other end disposed above the check ball 53, and biasing the ball 53 downwardly in the same manner as in the preferred embodiment. In either case, it is believed to be within the ability of those skilled in the art to select an appropriate biasing member for the particular lash adjuster and engine application, whereby the desired operation of the lash adjuster is achieved.

As is illustrated and described in above-incorporated U.S. Ser. No. 613,273, the check valve member may comprise a cylindrical member, or some other suitable member, other than a check ball, and such is also the case in connection with the present invention. Any check valve element which can be used in conjunction with a sealed leakdown lash adjuster can also be utilized with the present invention.

It is one important aspect or the present invention to select the spring 69 such that the hydrodynamic forces generated by the fluid flowing past the check ball 53 during the assembly operation are insufficient to close the check ball 53. Thus, the lash adjuster of the present invention may be filled with fluid prior to assembly into the engine, and the assembly process may still be carried out at the normal speed. On the other hand, the force of the spring 69 must not be such that it prevents the check valve 25 from closing during normal engine operation, as the plunger assembly 15 moves downward as was described previously.

Figure 3:
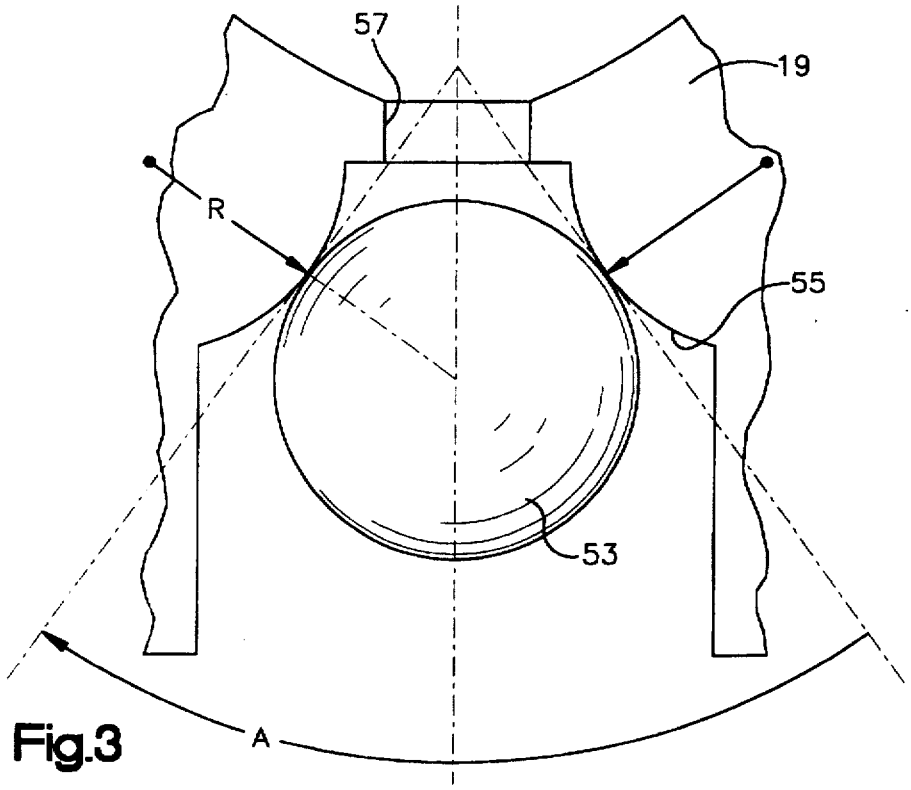
FIG. 3 is a further enlarged, fragmentary view, similar to FIGS. 1 and 2, illustrating the check valve seat configuration or the present invention.

Referring now primarily to FIG. 3, another important aspect of the invention will be described. By way of example only, and not by way of limitation, the valve seat 55 in the subject embodiment comprises a portion of a circle of radius R when viewed in cross-section. Those skilled in the art will recognize from the following description that various other curved surfaces could be utilized for the valve seat 55. It should be apparent that the line of contact between the check ball 53 and the valve seat 55 is a circle when viewed alone the axis of the plunger.

Illustrated in FIG. 3 is the angle of contact A between the check ball 53 and the valve seat 55. In designing the check valve assembly, it is important to select the angle of contact A to prevent wedging of the check ball 53 within the valve seat 55. It has been determined that in order to avoid such wedging, the angle of contact A should be greater than 30 degrees. It is believed to be within the ability of those skilled in the art to determine for any particular check ball and valve seat geometry the minimum angle of contact A necessary in order to prevent wedging.

In the event the valve seat 55 has an imperfection which permits leakage during testing, the configuration of the valve seat of the present invention is such that it may be repaired quickly and economically. In order to perform such repairs, it would be preferable to use a honing wheel having a cone angle substantially equal to the angle of contact A shown in FIG. 3. Thus, the valve seat 55 may be repaired by honing only a very small amount of material off of the valve seat, knowing that the honing wheel will engage the valve scat at the line of contact with the check ball. Furthermore, the curvature of the valve seat 55 makes it very likely that only a very small amount of material will need to be removed in order to eliminate the imperfection from the valve seat.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

We claim:

1. A hydraulic lash adjuster for an internal combustion engine, said lash adjuster comprising a body defining a blind first bore formed therein; a plunger assembly slidingly received within said blind first bore; a pressure chamber defined by said blind first bore and said plunger assembly; a fluid chamber disposed within said plunger assembly, and a supply of hydraulic fluid within said fluid chamber; said plunger assembly defining a valve opening providing fluid communication between said pressure chamber and said fluid chamber; a check valve member operatively associated with said valve opening for opening or closing said valve opening in response to a relative decrease or a relative increase, respectively, in the pressure in said pressure chamber; biasing means normally urging said plunger assembly outward of said blind first bore; characterized by:

(a) means operable to bias said check valve member toward an open position in opposition to the force of fluid flowing from said pressure chamber past said check valve member and through said valve opening to said fluid chamber;

(b) means operable to limit the movement of said check valve member toward said open position, away from said valve opening; and (c) said biasing means exerting sufficient force to maintain said check valve member open during assembly of said lash adjuster, but insufficient to maintain said check valve open during normal operation of said internal combustion engine.

2. A hydraulic lash adjuster as claimed in claim 1, characterized by seal means disposed between said blind first bore and said plunger assembly, and operable to prevent substantially the flow of fluid therethrough.

3. A hydraulic lash adjuster as claimed in claim 1, characterized by said plunger assembly defining a second bore disposed in the bottom of said plunger assembly and in open communication with said valve opening, said check valve member being disposed within said second bore.

4. A hydraulic lash adjuster as claimed in claim 3, characterized by said means operable to limit the movement or said check valve member comprises a retainer including a first surface in engagement with the bottom of said plunger assembly and a second surface in engagement with said check valve member in its fully open position.

5. A hydraulic lash adjuster as claimed in claim 4, characterized by said retainer comprising a generally cup-shaped member received over the bottom of said plunger assembly and having an outwardly extending flange formed thereon, said means biasing said plunger assembly comprising a helical spring acting between the bottom of said blind first bore and said flange.

6. A hydraulic lash adjuster as claimed in claim 1, characterized by said plunger assembly defines a spring seat and said means operable to bias said check valve member comprises a helical compression spring having its upper end in engagement with said spring seat and its lower end in engagement with said check valve member.

7. A hydraulic lash adjuster as claimed in claim 6, characterized by said valve opening and said plunger assembly cooperating to define a valve seat disposed outwardly of said helical spring, said helical spring being selected such that hydrodynamic flow from said pressure chamber can overcome the biasing force of said helical spring and move said check valve member to a closed position in engagement with said valve seat, as said plunger assembly moves downwardly in said blind first bore.

8. A hydraulic lash adjuster as claimed in claim 1, characterized by said plunger assembly defines a valve seat, said valve seat defining, in cross section, a curved surface, curved in a direction toward said check valve member to define between said valve seat and said check valve member a circular line of contact.

9. A hydraulic lash adjuster for an internal combustion engine, said lash adjuster comprising a body defining a blind first bore formed therein; a plunger assembly slidingly received within said blind first bore; a pressure chamber defined by said blind first bore and said plunger assembly; a fluid chamber disposed within said plunge assembly, and a supply of hydraulic fluid within said fluid chamber; said plunger assembly defining a valve opening providing fluid communication between said pressure chamber and said fluid chamber; a check valve member operatively associated with said valve opening for opening or closing said valve opening in response to a relative decrease or a relative increase, respectively, in the pressure in said pressure chamber; biasing means normally urging said plunger assembly outward of said blind first bore; characterized by:

(a) said plunger assembly defines a valve seat, said valve seat defining, in cross section, a curved surface, curved in a direction toward said check valve member to define between said valve seat and said check valve member a circular line of contact.

10. A hydraulic lash adjuster as claimed in claim 9, characterized by seal means disposed between said blind first bore and said plunger assembly, and operable to prevent substantially the flow of fluid therethrough.

11. A hydraulic lash adjuster as claimed in claim 9, characterized by said check valve member comprises a check ball.

12. A hydraulic lash adjuster as claimed in claim 11, characterized by said valve seat and said check valve member cooperating to define an included angle of contact A equal to at least thirty degrees.

13. A hydraulic lash adjuster as claimed in claim 9, characterized by said valve seat defining, in cross section, a portion of a circle of radius R.

* * * * *